US008303675B2

(12) United States Patent
Semrau et al.

(10) Patent No.: US 8,303,675 B2
(45) Date of Patent: Nov. 6, 2012

(54) SYSTEM FOR SYNTHESIS GAS PRODUCTION

(75) Inventors: Lothar Semrau, Essen (DE); Gregor Hock, Hattingen (DE)

(73) Assignee: UHDE GmbH, Dortmund (DE)

( * ) Notice: Subject to any disclaimer, the term of this patent is extended or adjusted under 35 U.S.C. 154(b) by 29 days.

(21) Appl. No.: 12/998,023

(22) PCT Filed: Aug. 14, 2009

(86) PCT No.: PCT/EP2009/005910

§ 371 (c)(1),
(2), (4) Date: Mar. 10, 2011

(87) PCT Pub. No.: WO2010/028732

PCT Pub. Date: Mar. 18, 2010

(65) Prior Publication Data

US 2011/0155957 A1 Jun. 30, 2011

(30) Foreign Application Priority Data

Sep. 11, 2008 (DE) ..... 10 2008 046 820

(51) Int. Cl.
*B01J 19/00* (2006.01)

(52) U.S. Cl. ..... 48/61; 48/128; 48/197 R; 48/202; 48/210

(58) Field of Classification Search ..... 48/61, 128, 48/197 R, 202, 210; 252/373.1, 373; 423/650, 423/651, 652
See application file for complete search history.

(56) References Cited

U.S. PATENT DOCUMENTS

| | | | | |
|---|---|---|---|---|
| 5,284,550 | A * | 2/1994 | Tanca et al. | 162/31 |
| 7,744,665 | B2 | 6/2010 | Holle et al. | |
| 2011/0173886 | A1 * | 7/2011 | Abraham et al. | 48/128 |

FOREIGN PATENT DOCUMENTS

| | | |
|---|---|---|
| DE | 10 2005 041 931 | 3/2007 |
| GB | 2 277 097 | 10/1994 |
| WO | WO 2007/125046 | 11/2007 |

OTHER PUBLICATIONS

International Search Report, PCT/EP2009/005910 dated Feb. 2010.

* cited by examiner

*Primary Examiner* — Timothy Vanoy
(74) *Attorney, Agent, or Firm* — Collard & Rose, P.C.

(57) ABSTRACT

With a system for synthesis gas production, having a reactor as well as a gas cooler/purifier connected with it in terms of flow, a solution is supposed to be created, with which the most compact possible connection between reactor, on the one hand, and the gas cooler or purifier, on the other hand, is made possible, whereby heat expansions that occur due to different temperatures are absorbed. This is accomplished in that the connection between reactor (1) and gas cooler/purifier (7) is formed by a horizontal connection piece (5) having a throttle element (6) configured as a Venturi element.

4 Claims, 2 Drawing Sheets

SYSTEM FOR SYNTHESIS GAS PRODUCTION

CROSS REFERENCE TO RELATED APPLICATIONS

Figure 1:
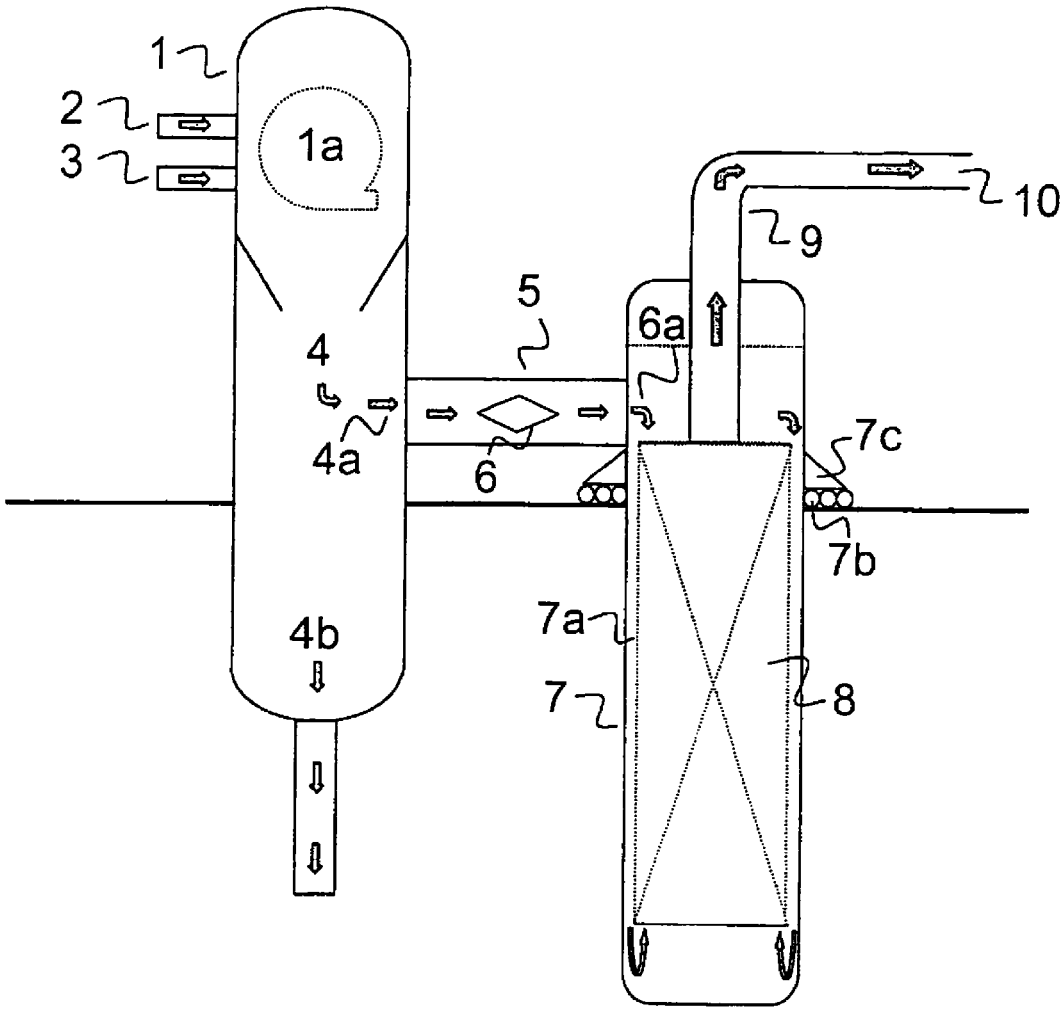

This application is the National Stage of PCT/EP2009/005910 filed on Aug. 14, 2009, which claims priority under 35 U.S.C. §119 of German Application No. 10 2008 046 820.7 filed on Sep. 11, 2008, the disclosure of which is incorporated by reference. The international application under PCT article 21(2) was not published in English.

The invention is directed at a system for synthesis gas production, having a reactor as well as a gas cooler/purifier connected with it in terms of flow.

Such systems are known in very different designs and combinations.

One possibility for producing synthesis gas consists in the gasification of carbonaceous fuels with a gas that contains oxygen. In this connection, a gas that contains carbon monoxide is formed, which gas can also contain hydrogen if water vapor is mixed in with the starting gas. The carbonaceous fuel is finely ground for the purpose of synthesis gas production, and reacted in an entrained flow gasification process or a fluidized bed gasification process, at high temperature. The synthesis gas produced in this way is contaminated with fine particles and acidic gases, as a result of the production process, so that a gas scrubbing process generally takes place. This is carried out in a gas scrubber, where the gas obtained is purified with a chemical or physical washing fluid.

The connection between the reactor and the gas scrubber is frequently made by means of pipelines, which are long and angled, because of the spatial distance from the reactor to the gas scrubber, and in which additional heat expansions must be taken into considerations, in terms of the design. Finally, a long pipe connection also leads to increased consumption of material in the construction of the system. For this reason, a shortened method of construction is aimed at in the construction of pipe connections.

The task of the invention consists in the creation of a solution with which the most compact possible connection between reactor, on the one hand, and the gas cooler or purifier, on the other hand, is made possible, whereby heat expansions that occur due to different temperatures are absorbed.

This task is accomplished, with a system of the type mentioned initially, in that the connection between reactor and gas cooler/purifier is formed by a horizontal connection piece having a throttle element configured as a Venturi element.

Such a horizontal "short connection" demonstrates a number of advantages. For example, the gas stream can be passed out of the reactor at the side, and can be passed into the device for gas scrubbing in the horizontal direction.

A further development of the invention provides that the throttle element, which lies on the inside, is configured to be adjustable.

For this purpose, a special embodiment of the invention consists in that the reactor is set up in a fixed location, whereby the connection piece is positioned on the reactor in the region of the mantle case that forms the fixed point, and whereby the gas cooler/purifier is provided with bearings that guarantee a horizontal movement.

The horizontal connection furthermore has the advantage that less caking, fewer deposits, and less erosion occurs. In this connection, it can be provided that the connection piece is equipped with one or more elements that lie horizontally and can change the cross-section for flow-through by means of an adjustment device that lies on the outside, in order to be better able to adapt the different gas streams by means of a flow-regulating quality of the micro-dust deposition process. In this connection, the elements can also be configured as setting elements or throttle elements.

In a further embodiment, it is provided that the connection piece is disposed in the head region of the gas cooler/purifier, whereby the gas is passed downward on the mantle side and/or centrally on or through the scrubber basket, to flow through the scrubber counter to the direction of gravity.

The invention also provides a method for synthesis gas production, whereby the gas is supplied to a gas scrubber from the reactor, which method is characterized in that the gas is deflected upward, from the direction of gravity, and is passed to the gas cooler/purifier, into its head region, through a horizontal pipe that might be configured as a Venturi scrubber, there is guided past a scrubber basket or through it, centered or on the mantle side, into the sump of the gas scrubber, and passed through the scrubber basket counter to the direction of gravity, and from there conveyed on as purified synthesis gas.

Further characteristics, details, and advantages of the invention are evident from the following description and using the drawings. These show, in FIGS. 1 and 2 two schematic representations of a coal gasification reactor, with a scrubber connected with it.

FIG. 1 shows a coal gasification reactor, which is connected with a gas scrubber using a connection piece according to the invention. In a coal gasification reactor 1, a coal gasification reaction is carried out with the addition of a carbonaceous fuel 2 and a reaction gas 3 that contains oxygen. The synthesis gas leaves the reaction zone 1*a* and is cooled down in a cooling zone 4 by means of the addition of a foreign medium. In this connection, a cooled synthesis gas 4*a* is obtained. The major part of the solid that occurs is carried out directed downward 4*b* in the reactor.

The synthesis gas is deflected and passed into a connection piece 5 that contains a throttle element 6. The latter is shaped in such a manner that it exerts a Venturi effect on the gas flowing through. The gas leaves the Venturi scrubber and is passed to a gas scrubber. It is deflected 6*a* behind the outlet of the connection piece. In this connection, it enters a ring space 7*a* between the gas scrubber wall 7 and the gas scrubber basket 8 or an inner pipe. At the bottom of the gas scrubber, the gas is deflected and flows upward in the gas scrubber basket 8. In this connection, it leaves the latter through a discharge connector 9. Purified synthesis gas 10 is obtained. The gas scrubber is mounted on roller bearings 7*b*, 7*c*, in order to absorb heat expansions of the connection piece. Other devices, such as slide plates or the like, can also be provided to absorb the heat expansions.

Figure 2:
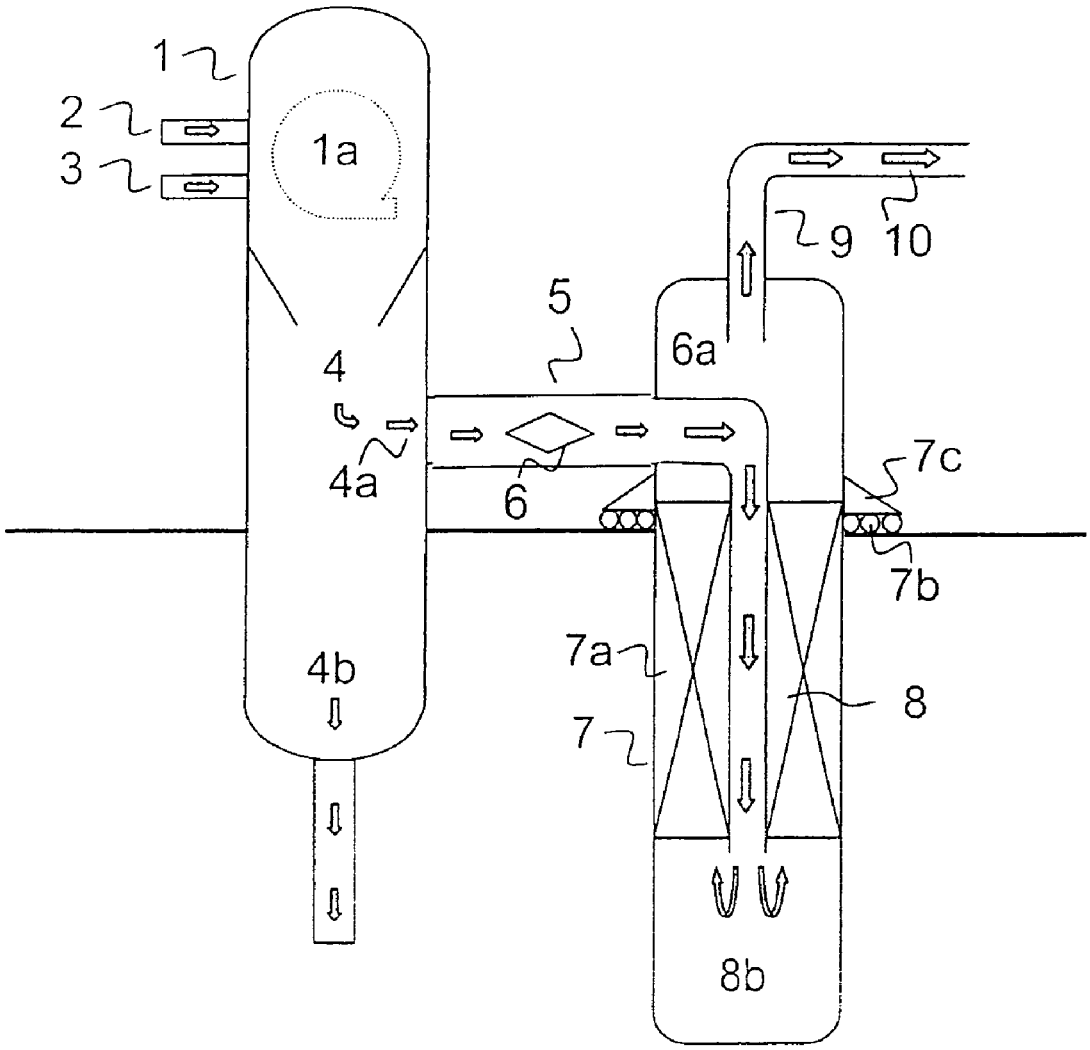

FIG. 2 shows a coal gasification reactor that is connected with a gas scrubber using a connection piece according to the invention. In a coal gasification reactor 1, a coal gasification reaction is carried out with the addition of a carbonaceous fuel 2 and a reaction gas 3 that contains oxygen. The synthesis gas leaves the reaction zone 1*a* and is cooled down in a cooling zone 4 by means of the addition of a foreign medium. In this connection, a cooled synthesis gas 4*a* is obtained. The major part of the solid that occurs is carried out directed downward 4*b* in the reactor.

The synthesis gas is deflected and passed into a connection piece 5 that contains throttle elements 6. These are shaped in such a manner that they exert a Venturi effect on the gas flowing through. The gas leaves the Venturi scrubber into a gas scrubber 7. In this connection it is deflected downward in the scrubber, by means of a pipe that lies on the inside, to the bottom of the gas scrubber 8*b*. It is deflected at the sump of the scrubber and flows upward through lateral scrubber baskets 7*a*, counter to fluid that flows in the opposite direction.

The gas leaves the lateral scrubber baskets 8 in an upward direction, flows out of them, and leaves the scrubber from a discharge connector 9 that sits on the scrubber ceiling. Purified synthesis gas 10 is obtained. Here again, the gas scrubber is mounted on roller bearings 7*b*, 7*c*, in order to absorb the heat expansions of the connection piece.

Of course, the invention is not restricted to the exemplary embodiments shown. Here, in the horizontal connection pipe, in particular, installations other than the ones shown can be provided, the bearings that absorb the heat expansion and allow movement can be configured in a different manner, whereby the common installation frame of reactor and scrubber that might be provided is no longer shown here.

REFERENCE SYMBOL LIST

1 coal gasification reactor
2 finely ground carbonaceous fuel
3 reaction gas that contains oxygen
4 cooling or quenching zone
4*a* crude synthesis gas
4*b* solids that occur from the gasification reaction
5 pipe-like connection piece
6 throttle element
6*a* deflected synthesis gas stream at the gas scrubber inlet
6*b* connection lever for control
6*c* connection lever as control element
7 gas scrubber
7*a* ring space
7*b* roller bearing for gas scrubber
7*c* guide element
8 scrubber basket
8*a* pipe lying on the inside
8*b* bottom of the gas scrubber
9 gas outlet
10 purified synthesis gas

The invention claimed is:

1. System for synthesis gas production, having a reactor as well as a gas cooler/purifier connected with it in terms of flow, wherein the connection between reactor (1) and gas cooler/purifier (7) is formed by a horizontal connection piece (5) having a throttle element (6) configured as a Venturi element.

2. System according to claim 1, wherein the throttle element (6) that lies on the inside is configured to be adjustable.

3. System according to claim 1, wherein the reactor (1) is set up in a fixed location, whereby the connection piece (5) is positioned on the reactor (1) in the region of the mantle case that forms the fixed point, and whereby the gas cooler/purifier (7) is provided with bearings (7*b*) that guarantee a horizontal movement.

4. System according to claim 1, wherein the connection piece (1) is disposed in the head region of the gas cooler/purifier (7), whereby the gas is passed downward on the mantle side and/or centrally on or through the scrubber basket (8), to flow through the scrubber counter to the direction of gravity.

* * * * *